US011882912B2

(12) United States Patent
Perkins

(10) Patent No.: US 11,882,912 B2
(45) Date of Patent: Jan. 30, 2024

(54) MAKEUP BLENDER AND APPLICATOR

(71) Applicant: RDP Services, LLC, Houston, TX (US)

(72) Inventor: Rhonda Perkins, Houston, TX (US)

(73) Assignee: RDP SERVICES, LLC, Houston, TX (US)

( * ) Notice: Subject to any disclaimer, the term of this patent is extended or adjusted under 35 U.S.C. 154(b) by 143 days.

(21) Appl. No.: 17/499,116

(22) Filed: Oct. 12, 2021

(65) Prior Publication Data

US 2023/0113103 A1 Apr. 13, 2023

(51) Int. Cl.

| | |
|---|---|
| ***A45D 33/00*** | (2006.01) |
| ***A46B 5/00*** | (2006.01) |
| ***A46B 13/02*** | (2006.01) |
| ***A45D 40/28*** | (2006.01) |
| ***A46B 15/00*** | (2006.01) |

(52) U.S. Cl.

CPC ..... *A45D 33/006* (2013.01); *A45D 40/28* (2013.01); *A46B 5/0095* (2013.01); *A46B 13/02* (2013.01); *A46B 13/023* (2013.01); *A46B 15/0004* (2013.01); *A45D 2200/1018* (2013.01); *A45D 2200/207* (2013.01); *A46B 2200/1046* (2013.01)

(58) Field of Classification Search

CPC ..... A46B 2200/1046; A46B 15/0004; A46B 13/023; A46B 13/02; A46B 5/0095; A46B 2200/207; A45D 40/28; A45D 33/06; A45D 2200/1018

USPC ..... 15/22.1

See application file for complete search history.

(56) References Cited

U.S. PATENT DOCUMENTS

| | | | | |
|---|---|---|---|---|
| 10,022,025 | B2 * | 7/2018 | Powell | A47K 7/043 |
| 2015/0245703 | A1 * | 9/2015 | Zelickson | A61H 7/005 134/6 |
| 2016/0015150 | A1 * | 1/2016 | Casasanta, III | A46B 5/0095 401/4 |
| 2020/0205552 | A1 * | 7/2020 | Shadduck | A45D 40/28 |

* cited by examiner

*Primary Examiner* — Katina N. Henson

(74) *Attorney, Agent, or Firm* — PERKINS COIE LLP; Michael A. Glenn

(57) ABSTRACT

An apparatus to facilitate makeup blending and application is disclosed. The makeup blender includes a body that provides a steady state vibration and is easily grasped by a human hand. The makeup blender is electrically powered by replaceable batteries or rechargeable batteries. The makeup blender provides for an attachment interface that facilitates easy snap on or off, for attachments such as a brush or a cotton ball holder. The electrically powered consistent vibration on an attachment such as a brush provides for even and smooth blending of makeup over the skin.

9 Claims, 2 Drawing Sheets

MAKEUP BLENDER AND APPLICATOR

FIELD OF THE INVENTION

This description relates generally to an apparatus for blending and applying makeup and specifically to an electric power vibrating mechanism with attachments to apply makeup over the skin.

BACKGROUND

Traditionally the makeup application process involves multiple time-consuming steps requiring manual dexterity. Proper application of makeup requires patience and experience. However, users often improperly attempt to blend the makeup by swiping and rubbing the substance over the moisturizer and skin, instead of following an even and regular back and forth motion. As each successive layer of makeup is applied, it becomes more difficult to blend the most recent layer with the ones already applied over the skin. Particularly, rubbing and swiping the makeup will not create a proper blend.

As can been seen by the above description, proper makeup blending is very time consuming. Many individuals don't have the time to focus on the proper blending technique leading to undesired results. Others often rub or swipe the makeup also leading to an undesirable makeup blend. Taking classes on proper makeup blending can be expensive and time consuming. Similarly visiting a professional makeup artist requires an appointment, loss of time, and added expenses. Accordingly, there is a need for an apparatus that facilitates and expedites makeup blending by removing the hand dexterity needed for proper makeup blending over the skin.

SUMMARY

An apparatus that facilitates proper application and blending of makeup over the skin is disclosed. In some embodiments the apparatus includes an even vibrating mechanism. The mechanism will have removeable attachments, such as blending brushes and sponges to perform the application. The apparatus will preferably be electric and have a power charging interface, such as a universal serial bus (USB) connector for power. In an embodiment the apparatus will have speed control to slow or increase the vibration speed. One end of the apparatus includes a face for adding attachments such as a brush that will perform the makeup blending functions over the skin.

In some embodiments, a makeup blender includes a three-dimensional housing having a first end, a second end opposite to the first end, and an external surface between the first end and the second end. The three-dimensional housing is shaped and sized to be gripped by a user's hand. An electric vibration device is enclosed and supported by the three-dimensional housing. The electric vibration device is configured to vibrate back-and-forth in response to receiving electric power. An attachment interface is connected to the first end of the three-dimensional housing and configured to receive an attachment that is secured to the attachment interface, such that the attachment is physically coupled to the electric vibration device and vibrates back-and-forth as the electric vibration device vibrates for blending makeup applied to the user's face. A power interface is connected to the second end of the three-dimensional housing and configured to receive the electric power from a power source. The electric power is provided to the electric vibration device. A power switch is attached to the external surface of the three-dimensional housing and electrically coupled to the electric vibration device. The power switch is configured to enable the power interface to provide the electric power to the electric vibration device when the power switch is placed in an on position. The electric power is shut off from the power interface to the electric vibration device when the power switch is placed in an off position. A speed selector is attached to the external surface of the three-dimensional housing and configured to enable the electric vibration device to vibrate at a first speed when the speed selector is placed in a low position. The electric vibration device vibrates at a second speed greater than the first speed when the speed selector is placed in a medium position. The electric vibration device vibrates at a third speed greater than the second speed when the speed selector is placed in a high position.

In some embodiments, the electric vibration device is an electric motor.

In some embodiments, the housing includes at least one of metal, wood, rubber, or plastic.

In some embodiments, the attachment interface is configured to receive the attachment, such that the attachment is inserted into the attachment interface, snapped into the attachment interface, or screwed into the attachment interface.

In some embodiments, the attachment is secured to the attachment interface, wherein the attachment is at least one of a brush attachment or a sponge attachment. The brush attachment is at least one of a foundation brush, a buffer brush, or a stipple brush.

In some embodiments, a plastic or metal rim encases an outline of the three-dimensional housing.

In some embodiments, the power interface includes at least one of a universal serial bus (USB) connector, a cord to a USB power source, or a cord to a wall power outlet.

In some embodiments, the power source includes at least one battery enclosed and supported by the three-dimensional housing.

In some embodiments, the battery is rechargeable via the power interface.

In some embodiments, an electric vibration device is enclosed by a housing shaped and sized to be gripped by a user's hand. The electric vibration device is configured to vibrate in response to receiving electric power. An attachment interface is connected to the housing and configured to physically couple a brush or sponge attachment to the electric vibration device, such that the brush or sponge attachment vibrates to blend makeup applied to the user's face as the electric vibration device vibrates.

In some embodiments, a power interface is connected to the housing and configured to receive the electric power from a power source. The electric power is sent to the electric vibration device.

In some embodiments, the power interface includes at least one of a universal serial bus (USB) connector, a cord to a USB power source, or a cord to a wall power outlet.

In some embodiments, the power source includes at least one battery enclosed and supported by the housing.

In some embodiments, a power switch is attached to the housing and configured to enable provision of the electric power to the electric vibration device when the power switch is placed in an on position. The electric power is shut off to the electric vibration device when the power switch is placed in an off position.

In some embodiments, a speed selector is attached to the electric vibration device and configured to enable the electric vibration device to vibrate at different speeds when the speed selector is placed in different positions.

In some embodiments, the attachment interface is further configured to receive the attachment, such that the attachment is inserted into the attachment interface, snapped into the attachment interface, or screwed into the attachment interface.

In some embodiments, a brush attachment is secured to the attachment interface, wherein the brush attachment is at least one of a foundation brush, a buffer brush, or a stipple brush.

These and other aspects, features, and implementations can be expressed as methods, apparatus, systems, components, program products, means or steps for performing a function, and in other ways.

These and other aspects, features, and implementations will become apparent from the following descriptions, including the claims.

DETAILED DESCRIPTION

In the following description, for the purposes of explanation, numerous specific details are set forth in order to provide a thorough understanding of the present embodiments. It will be apparent, however, that the present embodiments may be practiced without these specific details.

This document discloses an electric makeup blender and applicator device.

The embodiments disclosed herein present an electric makeup blender and application device that facilitates and expedites proper makeup blending over the skin of an individual. The embodiments disclosed eliminate the need for manual makeup blending and eliminate the common mistake of rubbing makeup for blending.

Figure 1:
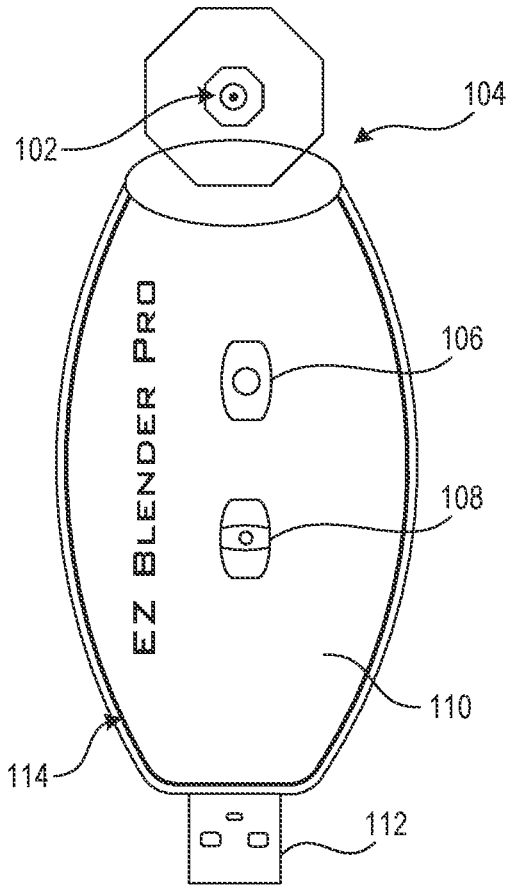
FIG. 1 is a diagram illustrating a perspective view of a makeup blending apparatus, in accordance with one or more embodiments.

FIG. 1 is a diagram illustrating a perspective view of an apparatus 104 for mixing and applying makeup. The apparatus 104 is sometimes referred to as a makeup blender. In some embodiments, the makeup blender 104 includes a three-dimensional housing 110 having a first end, a second end opposite to the first end, and an external surface between the first end and the second end. For example, the makeup blender 104 shown in FIG. 1 has a body, casing, or housing 110. The three-dimensional housing 110 is shaped and sized to be gripped by a user's hand.

In some embodiments, the housing includes at least one of metal, wood, rubber, or plastic. The housing 110 can be made of plastic, wood, metal, or Acrylonitrile Butadiene Styrene (ABS), which is an opaque thermoplastic and amorphous polymer sometimes referred to as "engineering plastic." The housing 110 can be of different colors including white, black, silver, red, green, or a combination thereof. In some embodiments, a plastic or metal rim 114 encases an outline of the three-dimensional housing 110. For example, an outline of the housing 110 is encased in a rim 114. The rim 114 can be made of plastic or metal. The rim 114 can be of different colors including rose, gold, chrome, or a combination thereof.

An electric vibration device is enclosed and supported by the three-dimensional housing 110. In some embodiments, the electric vibration device is an electric motor. The electric vibration device is configured to vibrate back-and-forth in response to receiving electric power. An attachment interface 102 is connected to the first end of the three-dimensional housing 110 and configured to receive an attachment (e.g., the brush attachment 202) that is secured to the attachment interface 102, such that the attachment (e.g., the brush attachment 202) is physically coupled to the electric vibration device and vibrates back-and-forth as the electric vibration device vibrates for blending makeup applied to the user's face. For example, the housing 110 of the makeup blender 104 includes an electric vibration device or motor that will vibrate at a generally steady frequency such that it provides an even back and forth movement of a brush attachment (e.g., the brush attachment 202) or a sponge attachment (e.g., the sponge attachment 210) that can be inserted into an attachment interface 102 of the makeup blender 104. The brush attachment 202 and the sponge attachment 210 are illustrated and described in more detail with reference to FIG. 2. Each such attachment can be inserted or snapped into the attachment interface 102 of the makeup blender 104, such that the attachment snaps into place. In alternate embodiments, the attachment is screwed into the attachment interface 102 of the makeup blender 104.

In a preferred embodiment, the movement of an attachment inserted into the attachment interface 102 of the makeup blender 104 is sideways in horizontal fashion. Commercially available vibration devices that can provide such movement include Daiwa Felicity Tapping Pro Electric Massage Machine™ and the Paloqueth Automatic Male Mastubator™ with 7 Thrusting Motions. The shape of the makeup blender 104 can be oval, rectangular, round, ridged, etc., and facilitates an easy grasp with a single hand and fingers.

A power switch 106 is attached to the external surface of the three-dimensional housing 110 and electrically coupled to the electric vibration device. The power switch 106 is configured to enable the power interface 112 to provide the electric power to the electric vibration device when the power switch 106 is placed in an "on" position. The electric power is shut off from the power interface 112 to the electric vibration device when the power switch is placed in an "off" position. For example, the makeup blender 104 will have an on/off power switch 106 in accordance with the embodiment shown in FIG. 1.

Some embodiments can have a control mechanism to control the speed of the vibration. The speed control switch 108 (sometimes referred to as a speed selector) is shown in FIG. 1. In some embodiments, the speed selector 108 is attached to the electric vibration device and configured to enable the electric vibration device to vibrate at different speeds when the speed selector 108 is placed in different positions. The speed selector 108 is attached to the external surface of the three-dimensional housing 110 and configured to enable the electric vibration device to vibrate at a first speed when the speed selector is placed in a "low" position. The electric vibration device vibrates at a second speed greater than the first speed when the speed selector 108 is placed in a "medium" position. The electric vibration device vibrates at a third speed greater than the second speed when the speed selector 108 is placed in a "high" position. For example, the speed control switch 108 can have low, medium, and high settings. Each setting presents a different resistance to the electric power supplied to the electric vibration device or motor to vibrate it at different speeds.

The makeup blender 104 will preferably run on electric power. A power interface 112 is connected to the second end of the three-dimensional housing 110 and configured to receive the electric power from a power source. The electric power is provided to the electric vibration device. In some embodiments, the power source includes at least one battery enclosed and supported by the three-dimensional housing 110. In some embodiments, the battery is rechargeable via the power interface 112. For example, the electric power can be provided by replaceable batteries within the body of the makeup blender 104. Alternatively, the makeup blender 104 will have an interface to a power source to charge rechargeable batteries also within the body of the makeup blender 104. In some embodiments, the power interface 112 includes at least one of a universal serial bus (USB) connector, a cord to a USB power source, or a cord to a wall power outlet. The embodiment of FIG. 1 shows the power interface as a universal serial bus (USB) connector 112. Alternatively, an embodiment can have a power interface that is a cord to a USB power source or a traditional three or two prong wall electricity receptacle.

The embodiment of FIG. 1 also shows the attachment interface 102 for the makeup blender 104. The attachment interface provides for easy connection (snap on or off) for any type of makeup applicator such as a brush or a cotton ball.

Figure 2:
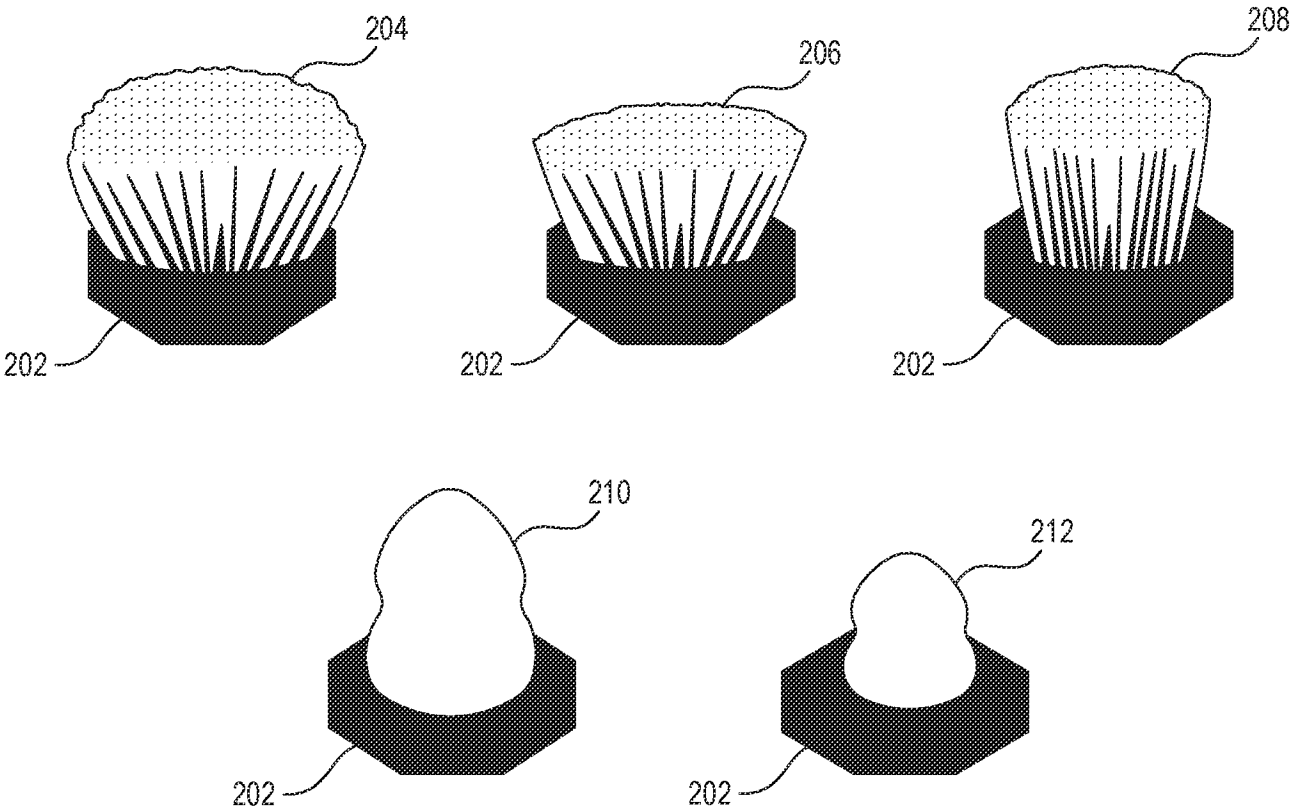
FIG. 2 is a diagram showing examples of brush attachments and sponge attachments that can be inserted into the makeup blending apparatus, in accordance with one or more embodiments.

FIG. 2 is a diagram showing examples of brush attachments and sponge attachments that can be inserted into the makeup blending apparatus, in accordance with one or more embodiments. FIG. 2 shows exemplary make up blender attachments, such as brush attachments or a sponge attachments. As shown in FIG. 2, a brush attachment stands on a base 202 that connects to the attachment interface 102. The attachment interface 102 is illustrated and described in more detail with reference to FIG. 1.

In some embodiments, the attachment interface 102 is configured to receive an attachment, such that the attachment is inserted into the attachment interface 102, snapped into the attachment interface 102, or screwed into the attachment interface 102. Different types of brushes can either be attached to the base 202 or be detachable and interchangeable from base 202. In some embodiments, the attachment is secured to the attachment interface 102, wherein the attachment is at least one of a brush attachment or a sponge attachment. The brush attachment is at least one of a foundation brush 204, a buffer brush 206, or a stipple brush 208. For example, the base can 202 can have a foundation brush 204, a buffer brush 206, or a stipple brush 208. The foundation brush 204 is used to ensure a smooth finish and is generally used for applying foundation. The foundation brush 204 allows the user to apply foundation faster than other methods. The foundation brush 204's head curves into a rounded or domed shape. The short to medium length bristles are dense and have the capabilities to move into the contours of an individual's face.

The buffer brush 206 is designed to apply various types of products (e.g., primer, bb cream, cc cream, blush, concealer, bronzer, or contour) and is generally used for smoothing and blending harsh areas to create a soft airbrushed finish. When used in a circular motion, a blotchy appearance can be avoided. The buffer brush 206 has densely packed bristles that are even length and gives the brush a flat-top appearance. The stipple brush 208 is designed for covering blemishes and scars and is generally used for heavy cream foundations and concealers. The bristles of the stipple brush 208 are long on the outer areas of the brush while the inner bristles are shorter and densely packed and fan out into a cone shape.

Similarly, the base 202 can have sponges of different sizes such as the sponge 210 or the sponge 212. Sponge attachments are generally used for different types of makeup application. Sponge attachments are beneficial for creating a poreless and seamless look that is more difficult to obtain by using a brush having bristles. The shape of the sponge attachments (e.g., the sponge 210) resemble an egg. Other attachments, such as cotton ball holders can also be used.

In an embodiment where the foundation brush 204 is attached to the makeup blender 104, the makeup substance (for example, a foundation, such as a cream or powder) is applied to the user's skin using the brush attachment 204 or a separate device. To blend the makeup on the skin, the makeup blender 104 is powered on. The brush attachment 204 will then encounter the makeup substance. The even vibration of the makeup blender will smoothly spread and mix the substance with any other previously applied makeup substances. In some embodiments, the makeup blender 104 is used to apply makeup in a phased process, where several cream or powder substances are serially applied using brushes (e.g., the foundation brush 204) or sponges (e.g., the sponge 210) on the skin. Each serial application of the substance over the skin blends the newly applied substance with the ones already applied. For example, the makeup blender 104 or another tool can be used to first apply a moisturizer over the skin, laying down a first foundational substance over the skin. Next, the makeup blender 104 can be used to apply a foundation over the moisturizer layer. The foundation is typically applied with the fingers, a sponge or a brush. The blending process is then initiated. This blending process provides aesthetic and functional benefits to the result. Next, the makeup blender 104 can be used to apply a concealer using, e.g., the sponge attachment 210. The makeup blending process continues with the application of the highlighter, blush, eyeshadow, and lip liner using the makeup blender 104 or another tool.

The makeup blender 104 and brush attachment 204 obviate the manual dexterity needed for proper makeup application and blending. The user of the makeup blender 104 can interchange the different sponges and brushes for the specific types of makeup or powder that is applied. Each time, the makeup blender 104 will provide a smooth and even vibration needed for improved makeup results.

The description and drawings herein are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any term discussed herein is illustrative only and is not intended to further limit the scope and meaning of the disclosure or of any exemplified term. Likewise, the disclosure is not limited to various embodiments given in this specification.

It is to be understood that the embodiments and variations shown and described herein are merely illustrative of the principles of this invention and that various modifications may be implemented by those skilled in the art.

I claim:

1. A makeup blender consisting of: a three-dimensional housing having a first end, a second end opposite to the first end, and an external surface between the first end and the second end, the three-dimensional housing shaped and sized to be gripped by a user's hand; an egg-shaped attachment secured to the makeup blender to blend makeup substances applied to the user's face; an electric vibration device enclosed and supported by the three-dimensional housing, the electric vibration device configured to vibrate back-and-forth in response to receiving electric power; an attachment interface connected to the first end of the three-dimensional housing and configured to receive the sponge attachment that is secured to the attachment interface, such that the sponge attachment is physically coupled to the electric vibration device and vibrates back-and-forth as the electric vibration device vibrates for blending makeup applied to the user's face; a power interface connected to the second end of the three-dimensional housing and configured to: receive the electric power from a power source, and provide the electric power to the electric vibration device; a power switch attached to the external surface of the three-dimensional housing and electrically coupled to the electric vibration device, the power switch configured to: enable the power interface to provide the electric power to the electric vibration device when the power switch is placed in an on position, and shut off the electric power from the power interface to the electric vibration device when the power switch is placed in an off position; and a speed selector attached to the external surface of the three-dimensional housing; wherein the speed selector is different from the power switch, and wherein the speed selector is configured to: enable the electric vibration device to vibrate at a first speed when the speed selector is placed in a low position, enable the electric vibration device to vibrate at a second speed greater than the first speed when the speed selector is placed in a medium position, and enable the electric vibration device to vibrate at a third speed greater than the second speed when the speed selector is placed in a high position.

2. The makeup blender of claim 1, wherein the electric vibration device is an electric motor.

3. The makeup blender of claim 1, wherein the housing comprises at least one of metal, wood, rubber, or plastic.

4. The makeup blender of claim 1, wherein the attachment interface is configured to receive the attachment, such that the attachment is inserted into the attachment interface, snapped into the attachment interface, or screwed into the attachment interface.

5. The makeup blender of claim 1, further comprising a brush attachment and wherein the brush attachment is at least one of a foundation brush, a buffer brush, or a stipple brush.

6. The makeup blender of claim 1, further comprising a plastic or metal rim encasing an outline of the three-dimensional housing.

7. The makeup blender of claim 1, wherein the power interface comprises at least one of a universal serial bus (USB) connector, a cord to a USB power source, or a cord to a wall power outlet.

8. The makeup blender of claim 1, wherein the power source comprises at least one battery enclosed and supported by the three-dimensional housing.

9. The makeup blender of claim 8, wherein the battery is rechargeable via the power interface.

* * * * *